US009211649B1

(12) United States Patent
Mollick et al.

(10) Patent No.: US 9,211,649 B1
(45) Date of Patent: Dec. 15, 2015

(54) KNIFE WITH FOLDING GUARD

(76) Inventors: Mark Mollick, Phoenix, AZ (US); Paul Mollick, Phoenix, AZ (US)

( * ) Notice: Subject to any disclaimer, the term of this patent is extended or adjusted under 35 U.S.C. 154(b) by 426 days.

(21) Appl. No.: 13/607,799

(22) Filed: Sep. 9, 2012

Related U.S. Application Data

(63) Continuation-in-part of application No. 12/655,713, filed on Jan. 5, 2010, now Pat. No. 8,286,356, which is a continuation-in-part of application No. 11/339,905, filed on Jan. 25, 2006, now Pat. No. 7,647,701.

(60) Provisional application No. 60/648,371, filed on Jan. 28, 2005.

(51) Int. Cl.

| | |
|---|---|
| ***B26B 3/06*** | (2006.01) |
| ***B26B 1/04*** | (2006.01) |
| ***B26B 29/02*** | (2006.01) |
| ***B26B 1/10*** | (2006.01) |

(52) U.S. Cl.
CPC . *B26B 1/042* (2013.01); *B26B 1/10* (2013.01); *B26B 29/02* (2013.01)

(58) Field of Classification Search
CPC ..... B26B 3/06; B26B 1/042; B26B 1/10; B26B 29/02
See application file for complete search history.

(56) References Cited

U.S. PATENT DOCUMENTS

| | | | | | |
|---|---|---|---|---|---|
| 488,340 | A * | 12/1892 | Skoglund | 30/160 |
| 749,230 | A * | 1/1904 | Severance | 30/160 |
| 845,792 | A * | 3/1907 | Jenkins | 30/162 |
| 1,545,542 | A * | 7/1925 | Albrecht et al. | 30/53 |
| 2,199,430 | A * | 5/1940 | Greve | 30/160 |
| 2,293,892 | A * | 8/1942 | Evinger | 30/286 |
| 2,316,246 | A * | 4/1943 | Hyatt | 30/153 |
| 2,901,824 | A * | 9/1959 | Zullo | 30/295 |
| 3,108,375 | A * | 10/1963 | Papp | 30/295 |
| 4,073,057 | A * | 2/1978 | Gilbert | 30/153 |
| 4,170,061 | A * | 10/1979 | Henry | 30/160 |
| 4,802,279 | A * | 2/1989 | Rowe | 30/155 |
| 5,440,814 | A * | 8/1995 | Hall et al. | 30/295 |
| 5,581,893 | A * | 12/1996 | Ouellette | 30/286 |
| 5,843,107 | A * | 12/1998 | Landis et al. | 606/167 |
| 6,170,158 | B1 * | 1/2001 | Daily | 30/161 |
| 6,233,832 | B1 * | 5/2001 | Berns | 30/162 |
| 7,325,312 | B1 * | 2/2008 | Janich | 30/161 |
| 7,533,465 | B1 * | 5/2009 | Frazer | 30/155 |
| 2005/0257377 | A1 * | 11/2005 | Lu | 30/153 |

* cited by examiner

*Primary Examiner* — Stephen Choi

(74) *Attorney, Agent, or Firm* — Thomas W. Galvani, P.C.; Thomas W. Galvani

(57) ABSTRACT

A guard for a folding knife which guard protects the fingers of the user when the blade is open. The guards may be lifted by the movement of the blade by a link, spring, lifting pin, gears, underside of the blade or hooked by thumb stud or back of blade or by a flipping motion due to the contour of the handles. The guards may be of various shapes and may be recessed in an out-of-the-way position when the blade is closed. The guards may extend at opposite sides of the blade and opposite sides of the handle. The guards are adaptable to a wide variety of folding knife styles.

6 Claims, 37 Drawing Sheets

1400

1500

KNIFE WITH FOLDING GUARD

CROSS-REFERENCE TO RELATED APPLICATIONS

This application is a continuation-in-part of U.S. patent application Ser. No. 12/655,713, filed Jan. 5, 2010, of the same title, which is based on continuation-in-part of U.S. patent application Ser. No. 11/339,905, now U.S. Pat. No. 7,647,701, filed Jan. 25, 2006, of the same title, which is based on U.S. Provisional Patent Application Ser. No. 60/648,371, filed Jan. 28, 2005, also of the same title.

TECHNICAL FIELD

This description relates generally to knives and more specifically to folding knives with guards which, when the knife blade is opened, are extendable to protect the hand and fingers of the user from sliding forward off the handle onto the blade thus preventing possible injury.

BACKGROUND

Folding knives of the type in which the blade is moveable between a position in the handle to an extended use position are well known and are very popular. Folding knives vary in style from the simple pocket knife to the more specialized knives such as hunting knives, bowie knives and camp knives. One popular folding knife is the well known scout knife which has a main blade and additional blades which may include leather punches, bottle openers, screw drivers, can opener and similar blades for specialized use. While these various types of folding knives may be provided in different sizes and different shapes, depending upon the particular style and intended use, they all include a main blade which is pivotally secured in a handle. In the unfolded or use position, the blade extends forwardly from the handle and the blade may be folded into the handle when not in use for safety and for compactness.

One particular safety concern when using knives, particularly folding knives, is that the user's hand can slip forwardly along the handle bringing the hand or fingers of the user into contact with the edge of the blade causing injury. As a result, there are suggestions in the prior art to provide various types of protection to the user's hand. Fixed blade knives often have a hilt which projects between the handle and blade as a safety feature.

U.S. Pat. Nos. 2,901,824 and 3,108,375 both show detachable finger guards for knives.

U.S. Pat. No. 6,233,832 shows a razor knife with a blade guard longitudinally displaceable on the handle between an outer, extended position and a retracted position exposing the point of the blade.

U.S. Pat. No. 2,293,892 shows a knife with a slidable blade guard which extends parallel with the space from the cutting edge to protect the user's thumb from the cutting edge when paring vegetables.

U.S. Pat. No. 4,170,061 shows a folding knife which has a cutting edge and projecting safety guard which is part of the blade.

U.S. Pat. No. 4,073,057 shows folding guards on a knife with a folding blade but the guards are for storage only when the blade is not in use and are in the nature of handle sections rather than guards.

U.S. Pat. No. 5,440,814 shows a knife with a fixed blade having pair of side guards mounted on the handle and moveable between an open and closed position. The guards enclose at least a portion of the blade when in the closed position. An actuating mechanism which includes a button moveable between a forward and rear position, is operable with a pair of side guards so that when the button is moved forward, the side guards move to the open position. When the button is moved rearwardly, the side guards move to the closed position.

Various types of guards or shields are commonly found with specialized knives such as utility knives. Reference is made to U.S. Pat. No. 5,581,893 which shows such a feature.

Pivotal swing guards mounted on the blade are available from manufacturers such as Solingen. These swing guards are hilt-like and close against the handle when the knife is closed, and open into the guard position when the blade is open.

While, as indicated above, there are various types of guards available with knives, there nevertheless exists the need for a guard for folding knives which is convenient, easy to use, which provides protection for the user's hands and fingers and which is both functional and aesthetically pleasing in design and detracting from the appearance of the knife. In particular a mechanism for coupling the guard to the blade in a rugged, economical and secure fashion improves producibility of the knife, and its attractiveness to users.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The present example provides a folding knife having one or more guards which are pivotally mounted to the blade or to the handle or liner. When the blade is in the closed position, the guard is positioned in an out-of-the-way location in a recess within the handle or on top of the handle. When the blade is opened, a pivot mechanism raises the guards to an open, locked position generally perpendicular to the knife handle to prevent the user's hand from slipping forward. The guards have a pivotal mounting section and a finger stop section. In particular the pivot mechanism includes a lift gear that is uniquely coupled to the blade, so that the blade and lift gear turn in unison. Alternative examples of the lift gear to blade coupling mechanism are provided, that tend to form an easily assembled and economic construction.

In one embodiment of the present invention, a lifting pin on one side or both sides of the blade rotates in a slot on the guard to raise or lower the guard by making contact with the slot ends. In another embodiment, the guard may be spring-actuated to the open position when the blade is opened. The folding guards can be any convenient shapes such as circular, rectangular, curved or other configurations, such as in the shape of an auxiliary tool. In the various embodiments, the lifting pins can be on the blade or guard and the folding guards can pivot about the same axis as the blade. In other embodiments, the guard may be a single or double guard which is raised by a link extending between the blade and guard. The various embodiments of the guard can be adapted to a wide variety of knife types and the folding guards can be used on knives with different locking mechanisms such as lock backs, liner locks, axis locks, button locks and the like.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe a folding knife. Although the present examples are described and illustrated herein as being implemented in a knife system, the system described is provided as an example and not a limitation. As those skilled in the art will appreciate, the present examples are suitable for application in a variety of different types of folding guard systems, such as folding saws and the like.

Figure 1:
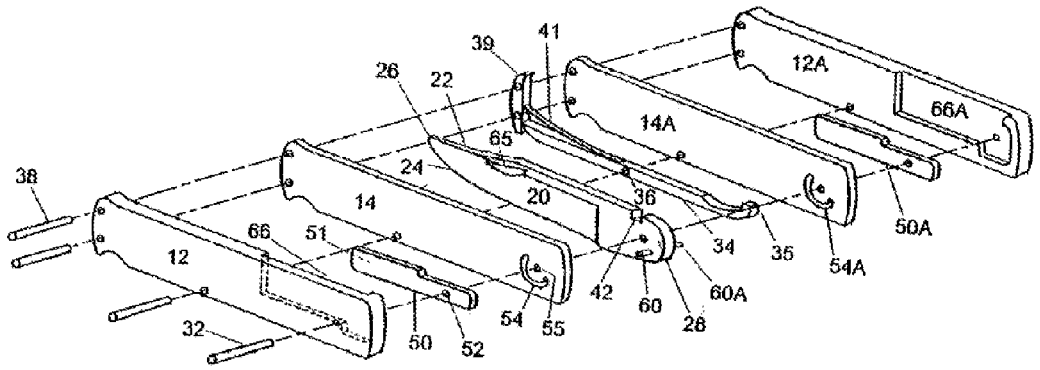
FIG. 1 is an exploded view of a folding knife provided with a guard according to the present invention.
Figure 1A:
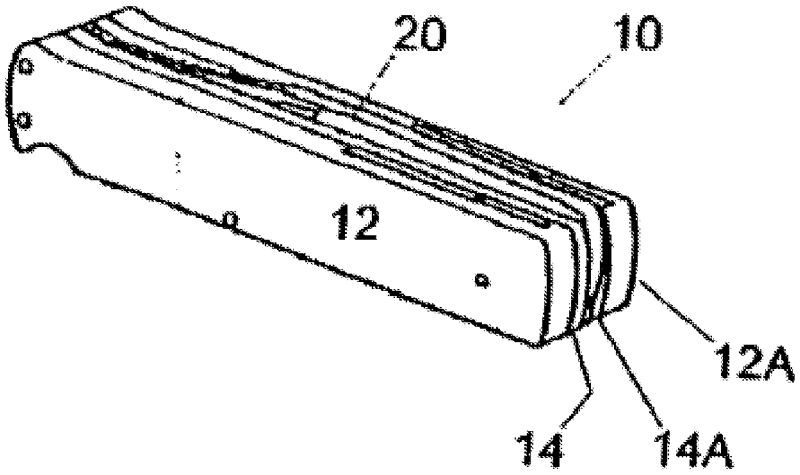
FIG. 1A shows the knife of FIG. 1 in a closed position.
Figure 1B:
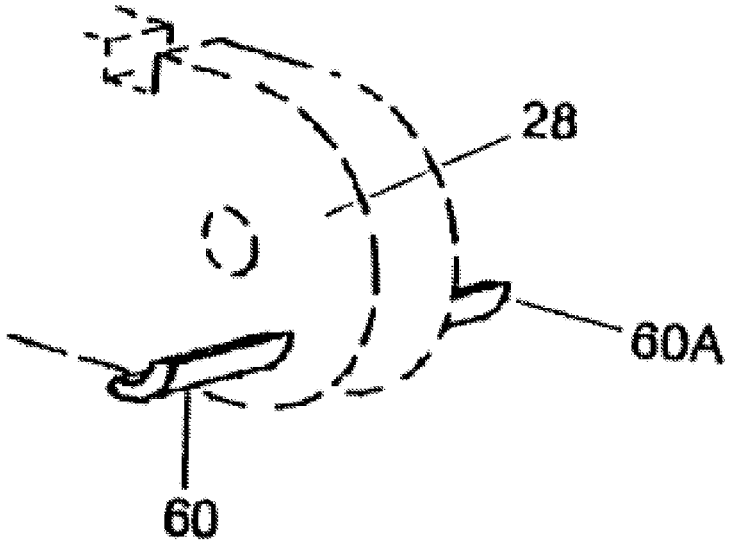
FIG. 1B is a detail view of the tang area of the blade.

Turning now to the drawings, FIGS. 1 to 1B show a representative knife construction of the type which may be provided with the various embodiments of a folding guard according to the present invention. As mentioned above, knives can have different shapes and dimensions and it will be understood that the following general description of a conventional construction of a folding knife is for background and understand it being appreciated that the present invention and its various embodiments apply to a wide variety of knife types, shapes and sizes. Also, throughout this application and in the various drawings showing various embodiments, the same or similar numerals will, for convenience, be used to identify the same or similar components such as the knife handle, knife blade and the like.

Folding knife 10 generally has opposite handle sections 12 and 12A. The outer surface of the handle section may be provided with a suitable decoration or functional overlay of plastic, bone or other material and may include bolsters. Liners 14 and 14A are positioned at the inner side of the handles 12 and 12A.

The main blade 20 is interposed between the liners. The main blade 20 has a back 22, edge 24, tip 26 and a rear tang 28. The blade is pivotal about a pivot pin 32 extending transversely through the handle and liners. A leaf-style, rocker bar 34 assists to maintain the blade in an open position having a detent 35 at its forward end. The bar 34 provides a positive spring action to "snap" the blade closed. The rocker bar pivots about rocker pivot 36. The assembly is secured by rivets or fasteners 38. The end of the bar carries a spacer 39 and a rocker spring 41 extends between the spacer 39 and the bar to apply pressure on the bar. In the open position, the rocker bar detent seats in recess 42 in the tang 28. The above is a general description of the construction of representative folding knives to assist in understanding the present invention. The same numerals are used throughout to designate the same or similar elements.

FIGS. 1 and 1B

The present invention provides a knife safety guard having a pivotal mounting section and finger stop which stop will extend to protect the hands and fingers of the user when the knife blade is in the open or extended position. As seen in FIG.

1, the safety guard assembly includes a pair of finger stops or guards 50, 50A. Each of the guards 50, 50A is shown as having a generally elongate lever-like body 51 having a bore at 52 at their inner ends. Guard 50 is interposed between handle 12 and liner 14. Similarly, guard 50A is interposed between liner 14A and the inner surface of handle 12A. The pivot pin 32 extends through the pivot bore 52 in the pivotal mounting section of the guards and the bushing 55 in the liner. Appropriate bushings 55 may be provided in the assembly for smooth operation.

An arcuate slot 54 is provided in liner 14 adjacent the bore. Similarly, arcuate slot 54A is provided in liner 14A adjacent the transverse bore 52. The slots are disposed below the associated bore and extend for an arc length of about 180 degrees.

The tang section 28 of the blade 20 carries lifting pins 60, 60A extending from opposite sides of the tang of the blade. The lifting pins 60 and 60A are disposed forwardly from the pivot pin 32 in the closed position. The pins 60, 60A are aligned with the arcuate slots 54 and 54A and project through the slots to engage the spaced-apart guards 50, 50A. It will be appreciated that when the knife is in the closed position, as shown in FIG. 1A, the guards assume an out-of-the-way position between the adjacent handle section and liner in the associated recesses 66, 66A. When the user wishes to use the knife, the user will engage the nail mark 65 on the blade and pivot the blade forwardly to the extended position. The pivoting of the blade will cause the lifting pins 60, 60A, to rotate about 90 degrees to abut the guards. As the lifting pins rotate further, the guards will be moved to a generally perpendicular position with respect to the knife disposed on either side of the blade 20. When the user folds the blade to the closed position, the blade will rotate about 90 degrees and then engage the guards causing them to rotate to the recessed, out-of-the-way position within the handle section. The inner surface of handles 12 and 12A each define a recess 66 and 66A configured to receive the guards in an out-of-the way position in the closed or retracted position.

FIG. 2

Figure 2:
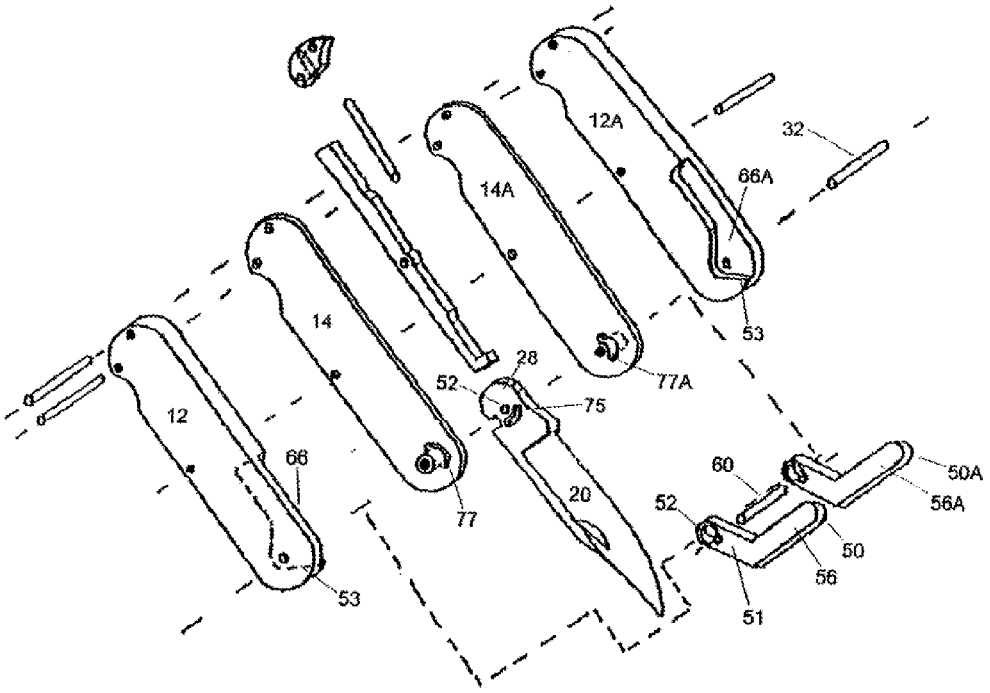
FIG. 2 is a exploded view showing yet another embodiment of the present invention in which the guards have an angular configuration.

Turning now to FIG. 2, another embodiment of the present invention is shown in conjunction with conventional folding knife 10 having handle sections 12 and 12A, liners 14 and 14A and blade 20 which is pivotally supported on a pivot pin 32 extending between the handles through the liners preferably in suitable bushings. The tang 28 of the blade 20 defines a generally arcuate slot 75, again having a common center with the center of the axis of the pivot pin 32. The arcuate slot 75 is displaced forwardly from the blade pivot 52 toward the point of the blade.

A pair of guards 50 and 50A are interposed between the handle and liners on either side of the blade 20. Each of the guards has a general V-shape with upper finger stops 56, 56A and lower pivotal mounting section 51 disposed at approximately a 45 degree angle with respect to the finger stop. The lower pivotal mounting sections 51 each define a bore 52 through which the blade pivot pin 32 extends. A lifting pin 60 extends between the guards 50, 50A and is secured to the lower sections 51 of the guards spaced from the pivot pin.

Arcuate slots 77, 77A are provided in the liners. It will be noted that the slots 77, 77A in the liners and the slot 75 in the blade 20 are positioned relative to one another so that as the blade 20 is manually rotated to the open position, the end of the slot 75 will not engage the lifting pin 60 until the blade is approximately perpendicular to the handles. Continued rotation of the blade will cause the end of the slot to move the guards upwardly out of their position in recesses 66, 66A in the handles. When the blade is fully extended, the finger stop section of the guards will extend generally vertically from the handle. The recesses 66, 66A are configured so the lower section 51 of the guards will rest on edge 53 of the recesses.

As the blade is closed, the blade will rotate approximately 90° at which time the opposite end of the slot in the blade will engage the lifting pin causing the guards to fold into the retracted position in their associated recesses 66, 66A when the blade is fully closed. An advantage of this embodiment is that the slot 75 in the blade is disposed forwardly in an area of the tang which generally has greater material width.

FIG. 3

Figure 3:
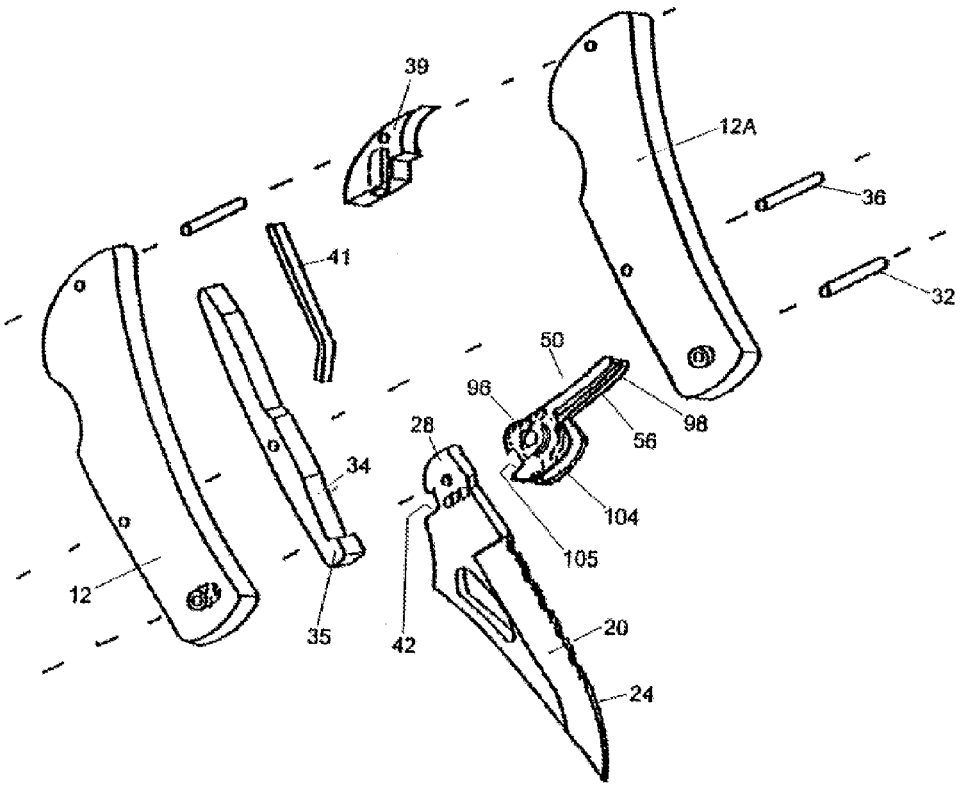
FIG. 3 shows an embodiment of a folding knife according to the present invention in which a single guard is held in an open position by the rocker bar.

In FIG. 3, yet another embodiment of the guard of the present invention is shown, again in conjunction with a knife having opposite handle sections 12 and 12A separated by a spacer 39 and a spring bar 41 intermediate the handle sections. A rocker bar 34 extends axially along the handle and has a projection or detent 35 at its forward end. The blade 20 is pivotally mounted between the forward sections of the handle and pivots on a pivot pin 32. Similarly, the rocker bar is pivotally mounted on a pivot pin 36 extending between the handle sections 12 and 12A.

The blade 20 has a notch 42 in the tang section 28. When the blade is in the open or extended position, the notch 42 will be engaged by the detent 35 or projection on the rocker bar to assist in maintaining it in the open position to prevent it from inadvertently closing when in use. The guard 50 has a mounting section with spaced-apart flanges 104 and upstanding finger stop 56. A transverse bore 96 extends between spaced-apart wall sections.

A blade-receiving groove 98 extends along the edge of the finger stop section of the guard. The spaced-apart sections of the guard each define a notch 105 which conforms to the shape of the notch in the tang of the blade. In the closed position with the blade in a protected position between the handle sections, the edge 24 of the blade will rest in the groove 98 in the face of the guard. When the blade is manually extended and the guard deployed to a generally perpendicular position with respect to the handle, the notch in the tang of the blade, as well as the notches in the lower body portion of the guard, will be engaged by the detent projection 35 on the forward end of the rocker bar. The end of the rocker bar 34 snaps into both the guard and the blade to assist in maintaining them in the open position. The lifting pin can be eliminated if the underside of the blade is used to lift the guard into the open position.

Figure 4:
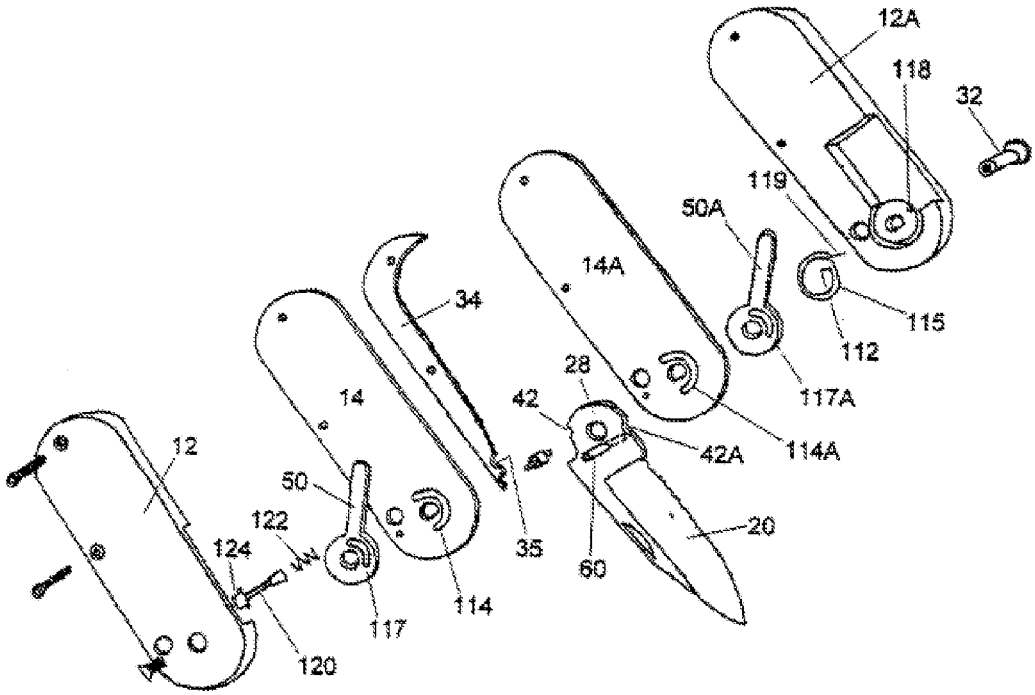
FIGS. 4 and 4A illustrate a guard which may be used in connection with automatic or spring-activated knives.
Figure 4A:
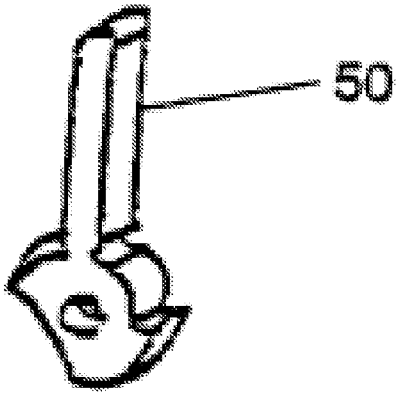

FIGS. 4 and 4A

FIGS. 4 and 4A show an embodiment for automatic knives having a pair of guards 50 and 50A disposed on opposite sides of the blade 20 which pivot on pin 32. Arcuate slots 114, 114A in the liners 14, 14A align with slots 117, 117A in the pivotal mounting section of the guards. A lifting pin 60 extends through the aligned slots in the liners and guards. The lifting pin engages one end 112 of a coil spring 115. The opposite end 119 of the spring seats in a bore 118 in the handle section. Alternatively, the spring end 112 can be extended through the 90° slot in the guards directly into the blade itself. The spring end 112 goes through the blade and makes contact with both guards. In this manner, the spring acts as a lifting pin as well.

The blade 20 is retained in a closed position by detent pin 120 which is spring biased by spring 122. When the detent button 124 is depressed, the retention force is released allowing the coil spring 115 to pivot the blade to the open position in which the detent pin 120 is seated in the notch 42 in the tang 28. In the closed position, notch 42A is engaged by the detent pin 120. The lifting pin 60 on the blade will rotate upwardly and forwardly engaging the forward ends of the slots in the guards rotating them to an upright position.

FIG. 4A shows an alternate configuration for the guard 50 having a base shaped or relieved to provide clearance for the button lock of the type used on automatic knives.

Figure 5:
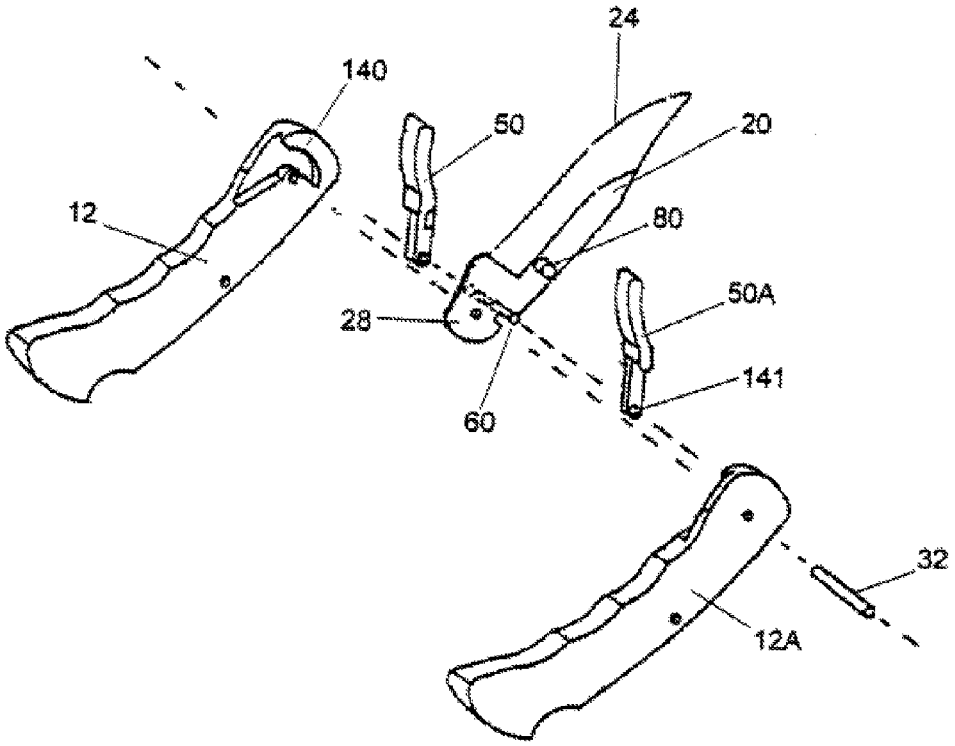
FIGS. 5 and 5A illustrate a pair of guards pivotal by a lifting pin that is attached to the blade which pin can be moved to various locations on the blade permitting a corresponding change in the configuration of the guard, handle and liner.
Figure 5A:
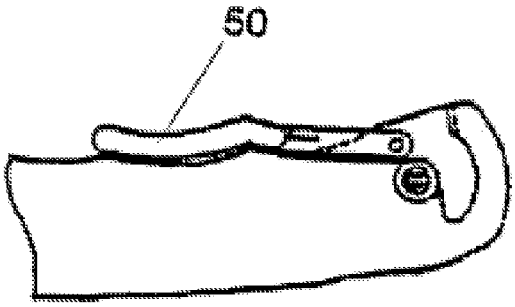

FIGS. 5 and 5A

Turning to FIGS. 5 and 5A, a knife with guards 50, 50A is shown having opposite handle sections 12, 12A, having their pivot locations centered on the lifting pins. It is to be noted that in these various embodiments, liners may or may not be included. The knife has a blade 20 with a blade edge 24 and a tang 28. A pivot pin 32 extends transversely through the tang portion of the blade and is received in bores in the forward end of the handle. A lifting pin 60 extends transversely from the blade forward of the pivot pin. The lifting pin 60 extends through bores 141 in the lower mounting end of the guards 50, 50A. In the closed position, a thumb stud 80 projecting from the blade holds the guards closed. When the blade is rotated to the open position, the lifting pin 60 will rotate with the blade to pull the guards to an open position by first applying a dragging motion and then a flipping motion to the guards as the lifting pin 60 passes by the contour defined by the blade's pivot pin 32. Note the lifting pin can be placed at different positions on the blade with a corresponding change in the configuration of the guards and the shape and location of the recesses 140 in the handles.

Figure 6:
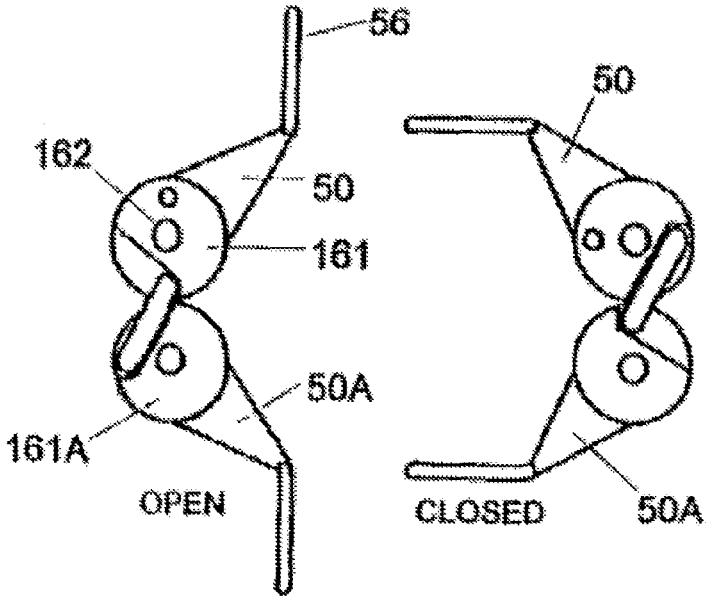
FIGS. 6 to 6B show double-sided guards which are joined by a linkage which when extended project both from the top and bottom of the knife handle.
Figure 6A:
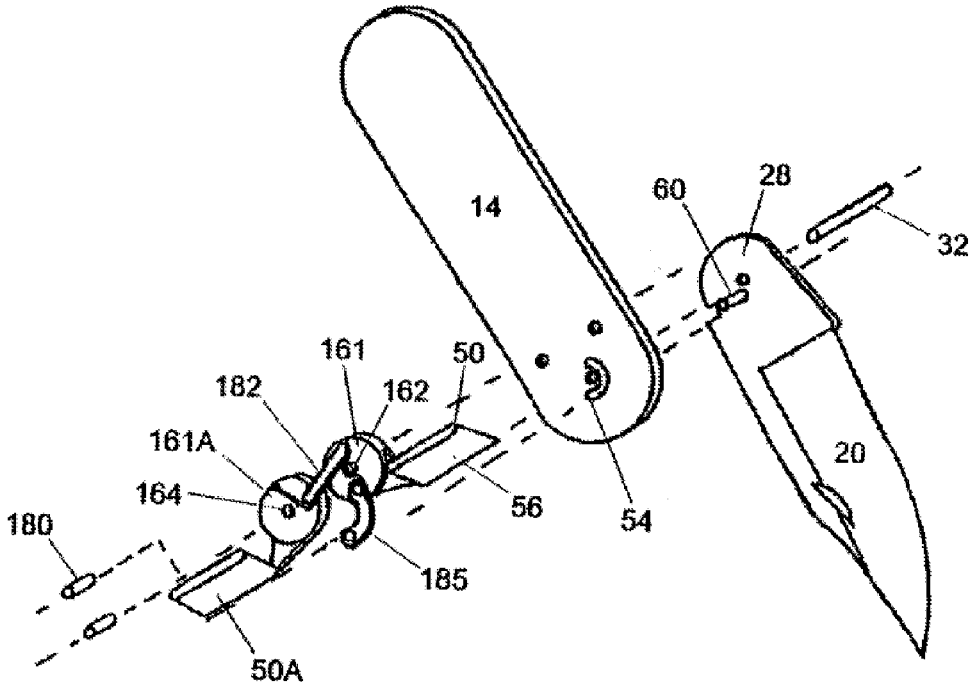
Figure 6B:
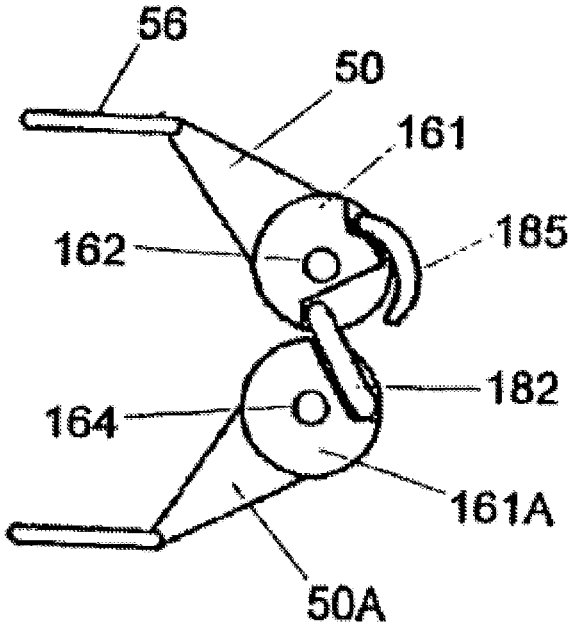

FIGS. 6 to 6B

FIGS. 6, 6A and 6B illustrate dual top and bottom guards in which both guards 50, 50A are raised by a lifting pin 60 located on the blade 20. FIG. 6 illustrates both the closed and deployed position. Referring to FIG. 6A, the blade 20 has a tang 28 with a pivot bore which receives a pivot pin 32. The pivot pin extends through the adjacent liners into opposite handles. A pair of opposed guards 50, 50A are shown disposed adjacent the liner 14. Similarly, another pair of guards may be provided on the opposite side of the blade and will operate in the same manner as those shown.

The upper guard 50 has a circular base 161 with a center circular bore 162 which is coincident with blade pivot 32, as seen in FIG. 6 which represents one optional construction. The upper guard has an upwardly projecting finger stop or paddle 56. Similarly, the lower guard has a circular base 161A which has a central circular bore 164 which is pivotal about a pivot pin 180 disposed below the upper pivot pin. The blade carries a lifting pin 60 which extends transversely through the slot 54 in liner 14. The upper end of link 182 is pivotally connected to circular base 161 and the lower end to base 161A. Arcuate link 185 connects the base of the upper guard to the lifting pin in one option as seen in FIG. 6A. Another pair of upper and lower guards 50, 50A, as described above, may be provided on the opposite side of the blade so two guards project both upwardly and downwardly from the handle. Both the open and closed positions of one pair of guards are shown in FIG. 6 and it will be understood that the lifting pin operating through links 185 and 182 will simultaneously deploy and close the guards shown in FIG. 6B.

Figure 7:
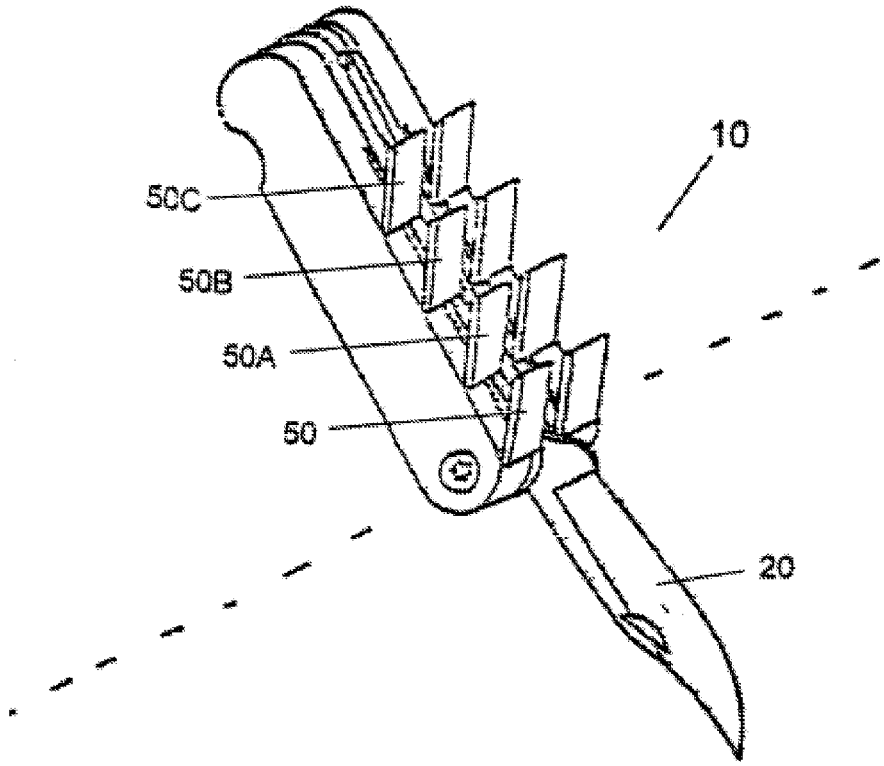
FIGS. 7 through 7B show an embodiment in which the knife is provided with multiple in-line guards which are simultaneously raised and lowered.
Figure 7A:
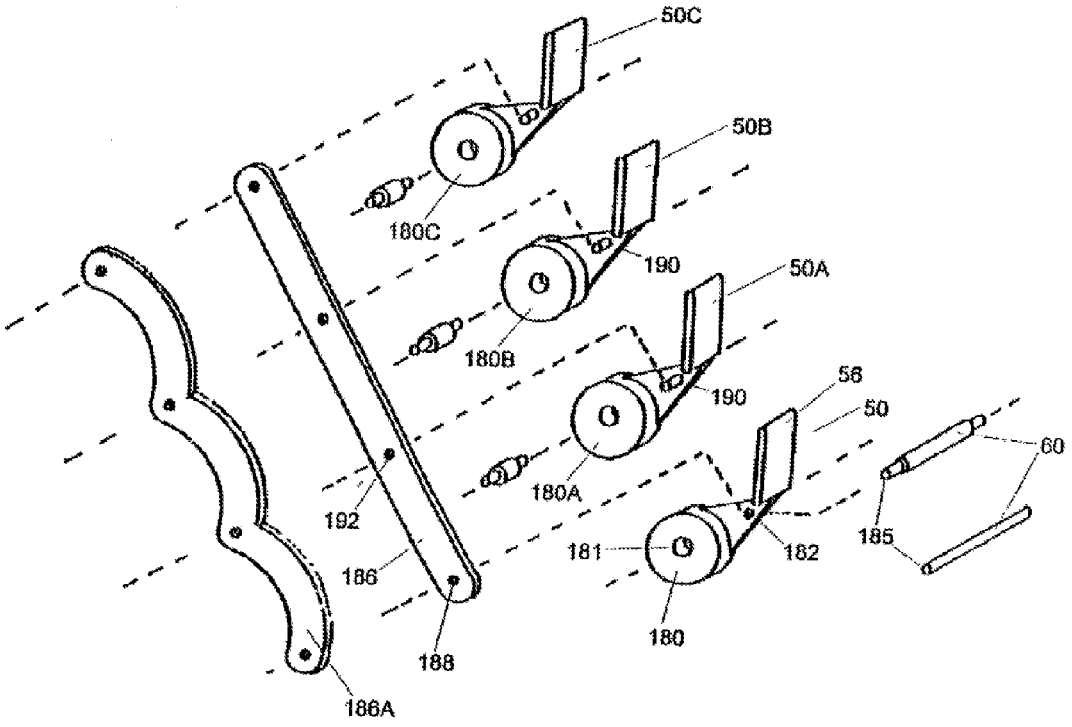
Figure 7B:
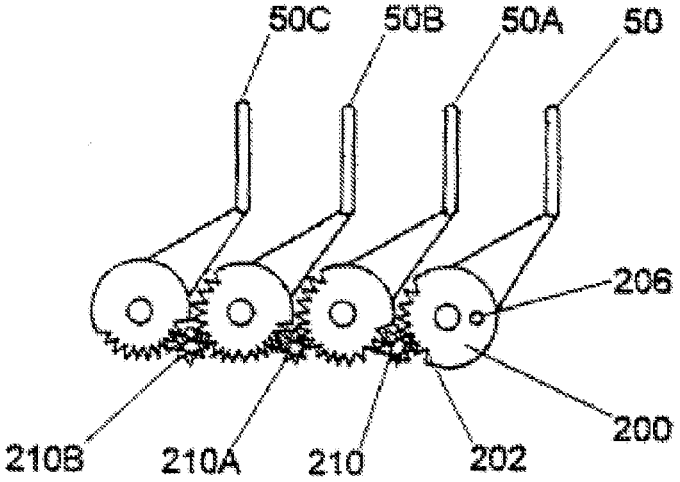

FIGS. 7 to 7B

FIGS. 7, 7A and 7B show a knife 10 provided with a plurality of spaced-apart, inline guards 50, 50A, 50B and 50C. The spaces between the guards define areas for receiving the user's finger.

In FIGS. 7, 7A, the forward guard 50 has a circular base and an upstanding finger stop or paddle 56. The mounting section 180 has a central pivot bore 181 through which a pivot pin or screw post for the blade extends. Radially offset from the pivot bore is a bore 182 which receives a lifting pin 60 which extends through the blade.

The lifting pin 60 defines bearing surface 185 at its opposite ends. An axially extending link 186 has a bore 188 at its forward end which receives the bearing surface 185 at the end of the lifting pin. The additional guards are pivotally arranged in spaced-apart relationship along the link 186, three being shown. Each of the guards, again, has circular mounting sections 180A, 180B and 180C with a central pivot bore and an upstanding finger stops. A pivot post 190 projects from the flange area of these guards and is received in adjacent bore 192 in the axially extending link 186. The link 186 may be axial or have arcuate sections as identified by the numeral 186A.

It will be seen that, as the blade 20 is rotated from the closed to the open position, the lifting pin 60 and link 186 will rotate the guards 50, 50A, 50B and 50C to their open position in which the guard portions extend upwardly and are spaced apart along the top surface of the knife. The spacing is selected to accommodate the fingers of the user. This is seen in FIG. 7.

FIG. 7B shows an alternate arrangement of actuating a plurality of spaced-apart guards 50 to 50C. In this embodiment, the forward guard 50 has a circular mounting section 200 and a finger stop. A portion of the periphery of the circular section defines gear teeth 202. The forward guard has a bore 206 offset from the pivot bore which receives a lifting pin which rotates the guard 50 between an open and closed position in the manner as has been described previously. The additional guards 50A to 50C are similarly constructed, each having a circular mounting section. Each is pivotal about a pivot axis extending between the handle sections and the liners. Approximately 180 degrees of the surface of the circular section of the guards 50A, 50B and 50C define gear teeth 202. The teeth do not directly contact one another. Small gears 210, 210A, 210B are interposed between the first and second guards (50, 50A), the second and third guards (50A, 50B) and the third and fourth guards (50B, 50C). The gears 210 to 210B are transfer gears and transfer the motion of the forward lift pin actuated guard 50 to the remaining guards so that they simultaneously move between the open and closed positions when the blade 20 is rotated between the open and closed positions.

Figure 8:
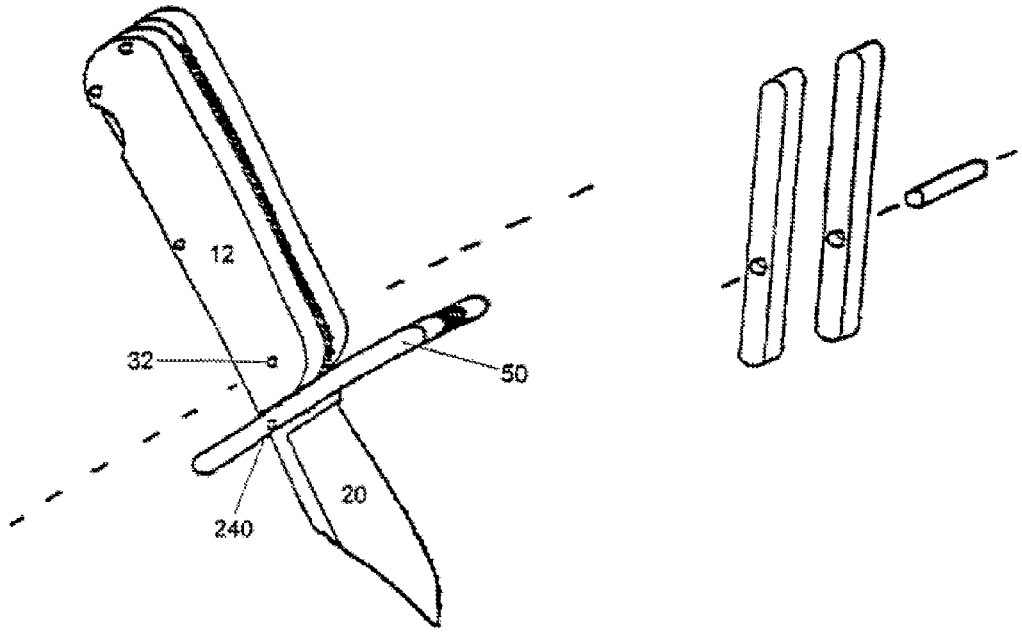
FIGS. 8 and 8A show another version having a guard which is "dragged" and "flipped" to the deployed position when the blade is opened.
Figure 8A:
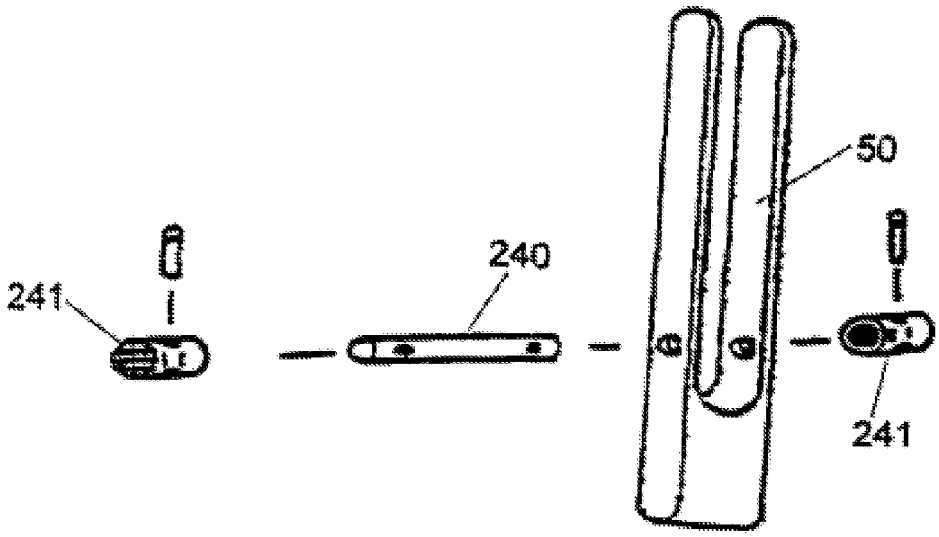

FIGS. 8 and 8A

In FIG. 8, the guards 50 are pivotally attached to blade 20 forward of the blade pivot 32 at a pivot 240 disposed toward the back 22 of blade 20. The guard 50 may take various shapes and is shown as an elongate bar. As the blade is manually opened, the guard 50 will engage the front edge of the knife and be "dragged" and "flipped" to the deployed position.

In FIG. 8A, the guard 50 is a slotted, one-piece section pivotal about pivot pin 240 and is dragged and flipped to the deployed position. The ends of the pivot pin 240 are provided with thumb stud caps 241 to assist in opening the blade 20 and guard 50.

Figure 9:
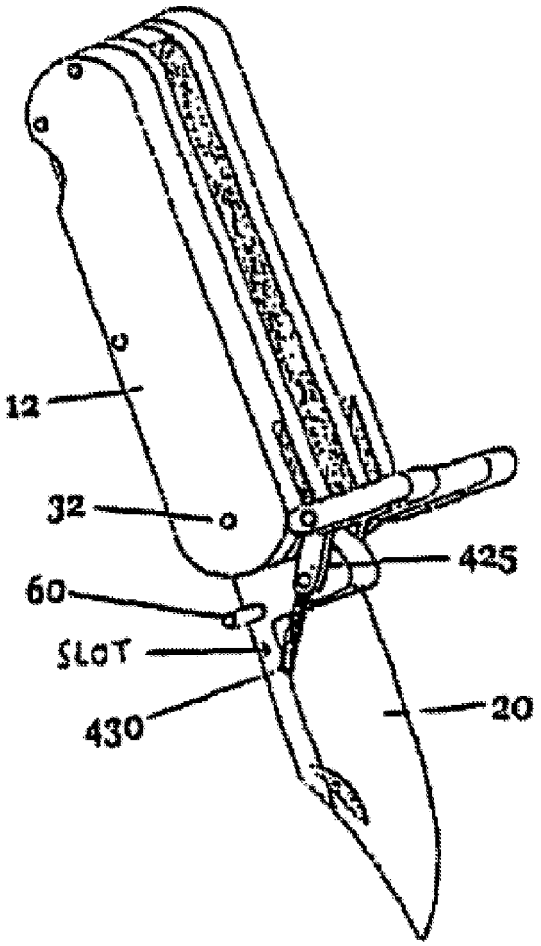
FIG. 9 is a perspective view showing a knife with dual guards attached to the inside of the guard.
Figure 9A:
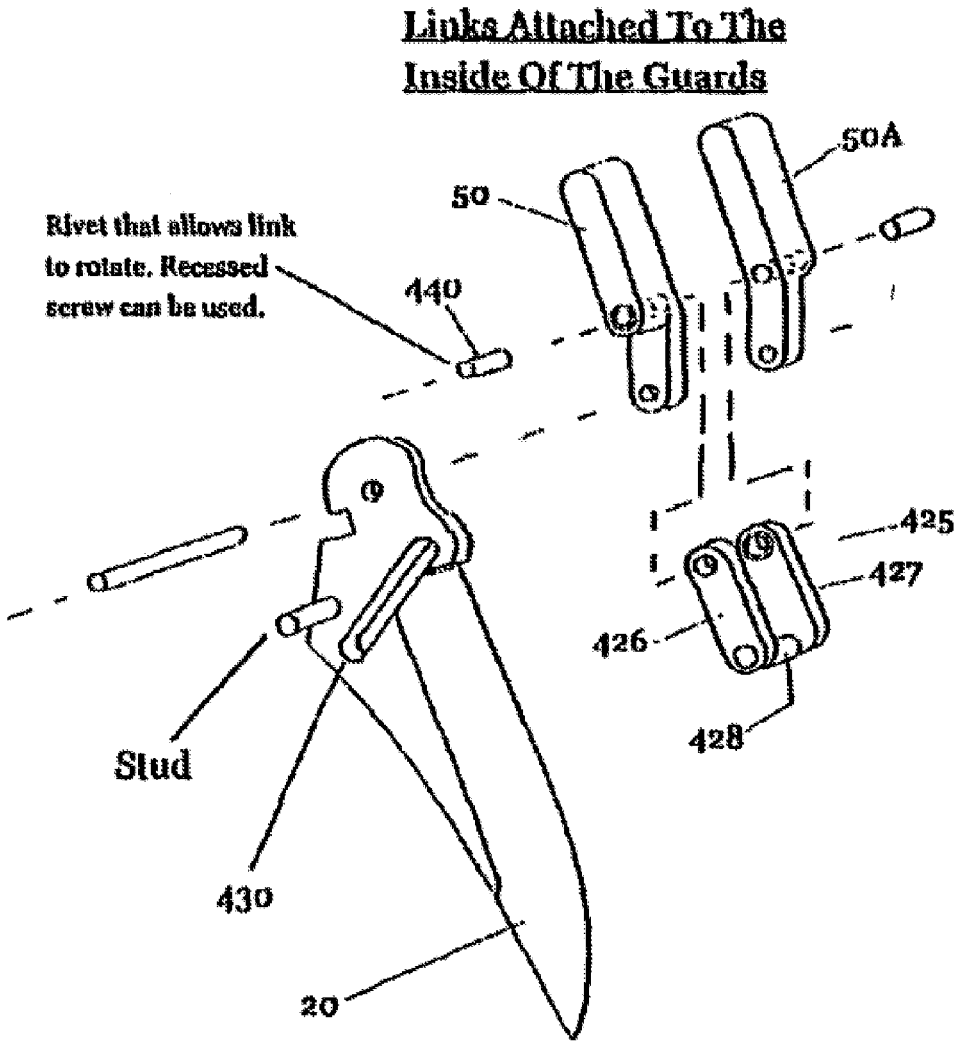
FIG. 9A is an exploded detail view similar to FIG. 9 showing links attached to the inside of the guards.
Figure 9B:
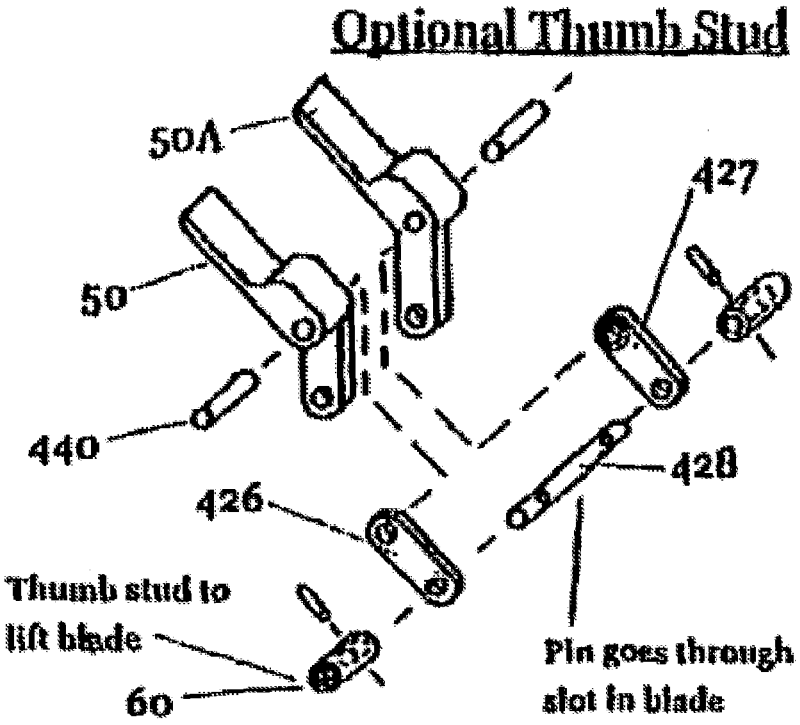
FIG. 9B shows guards provided with a thumb stud to lift the blade.
Figure 9C:
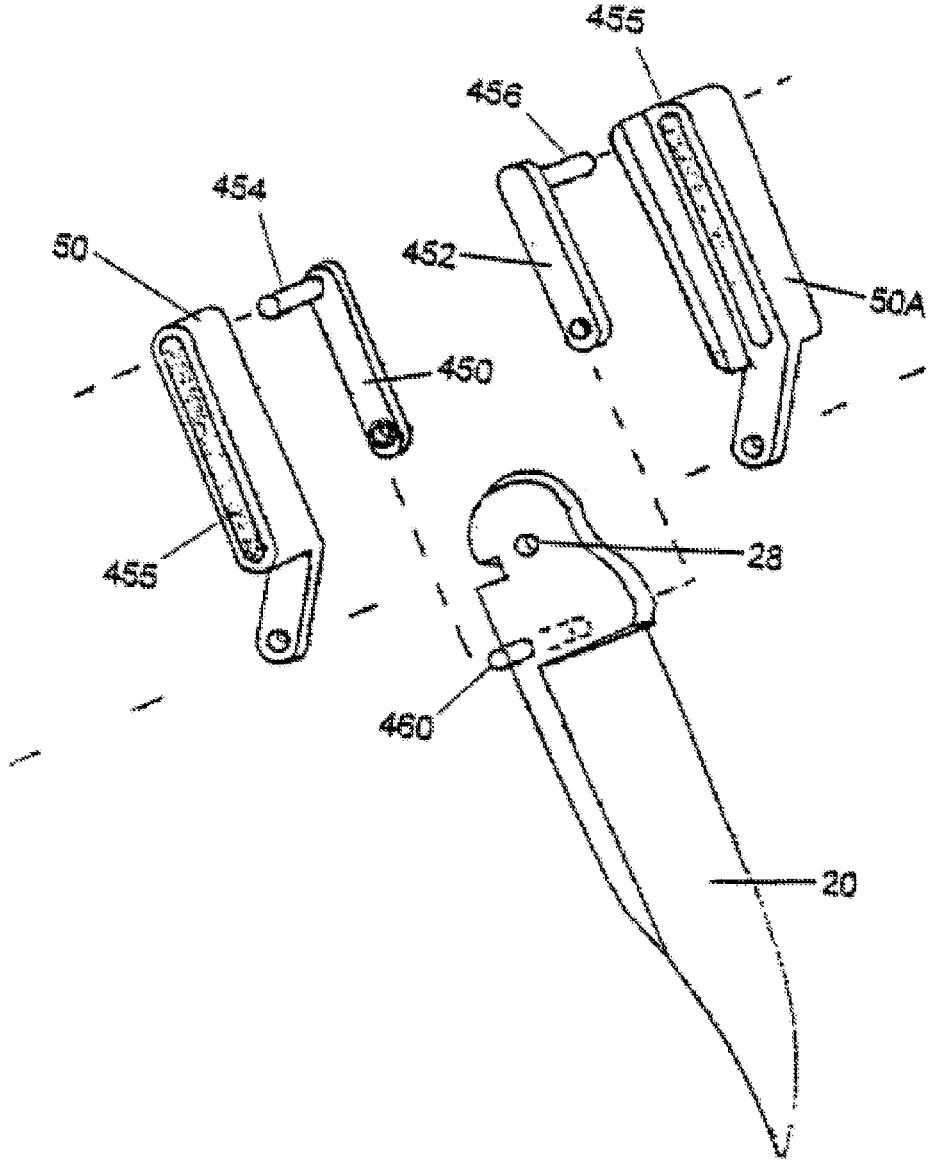
FIG. 9C is a view similar to FIG. 9B showing slots provided in the guards.
Figure 9D:
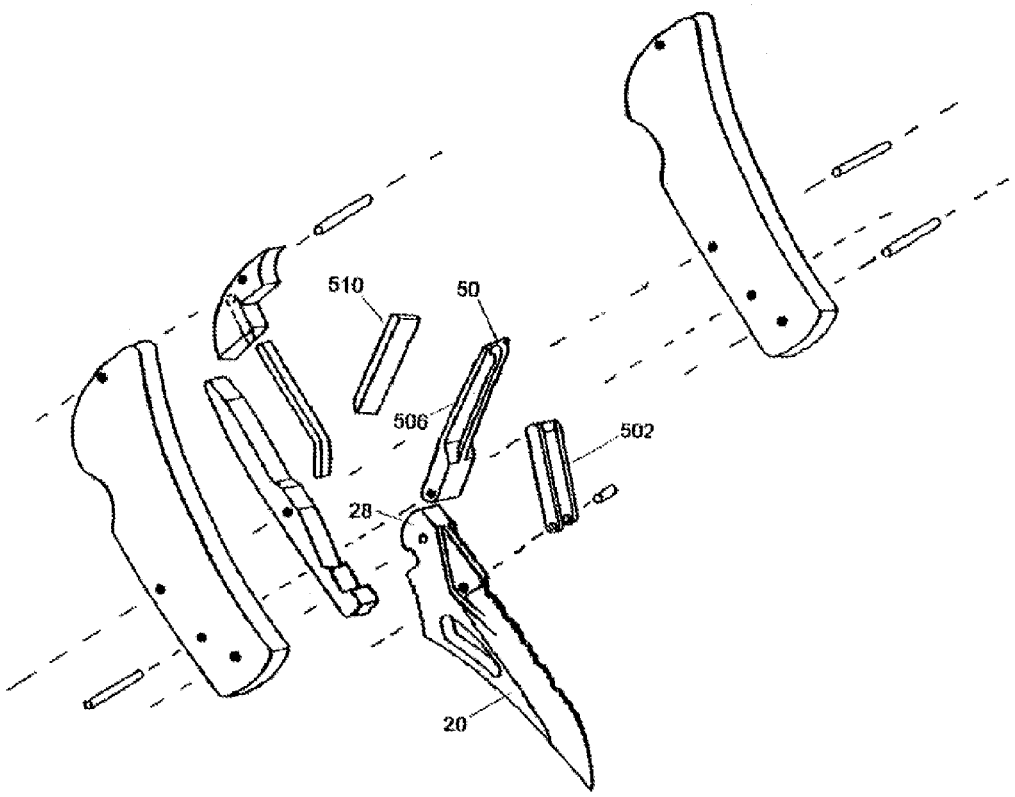
FIG. 9D is an exploded view showing a blade attached to a linkage having one end slidable in a slot.
Figure 9E:
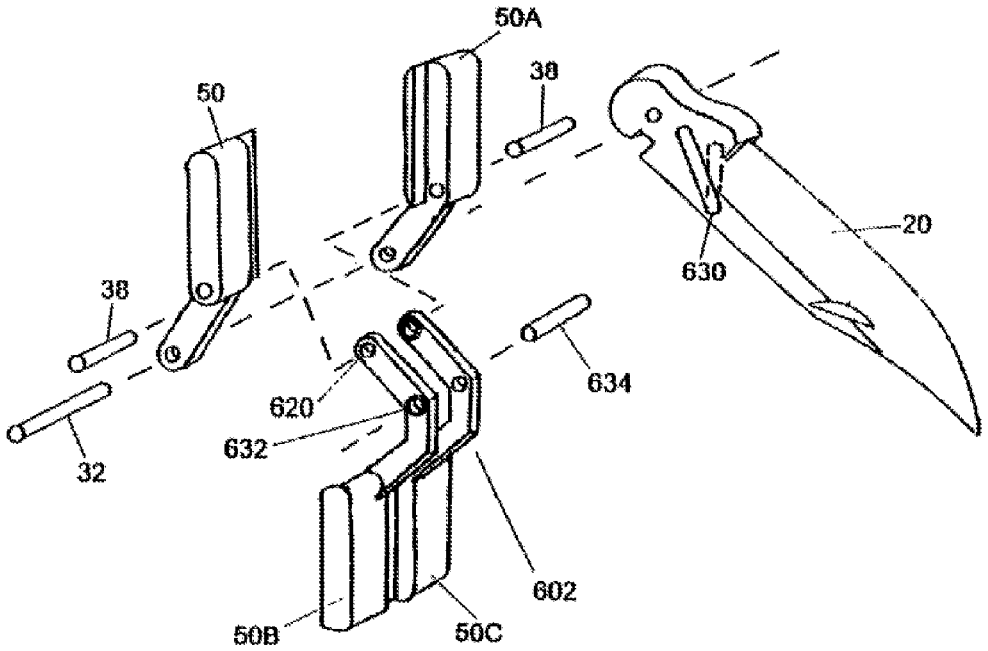
FIG. 9E shows an embodiment having quadruple guards actuated by links engaging a slot in the blade.
Figure 9F:
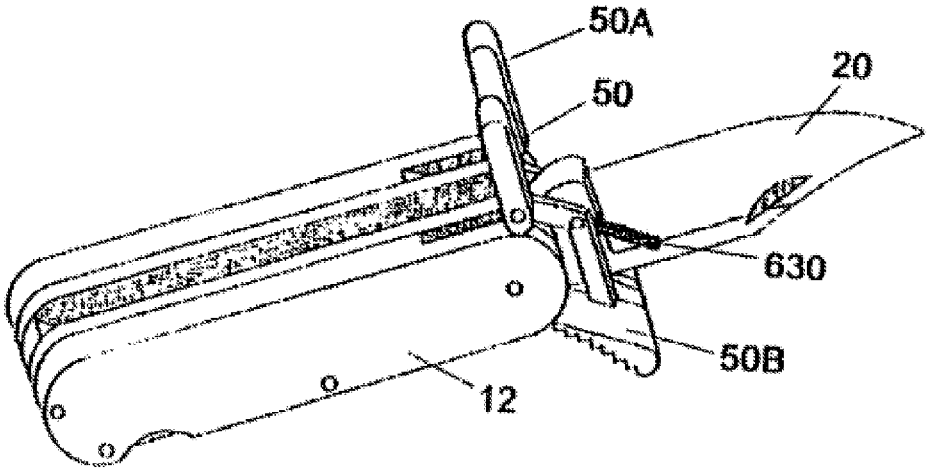
FIG. 9F shows the blade in an open position which deploys both the upper and lower guards.
Figure 9G:
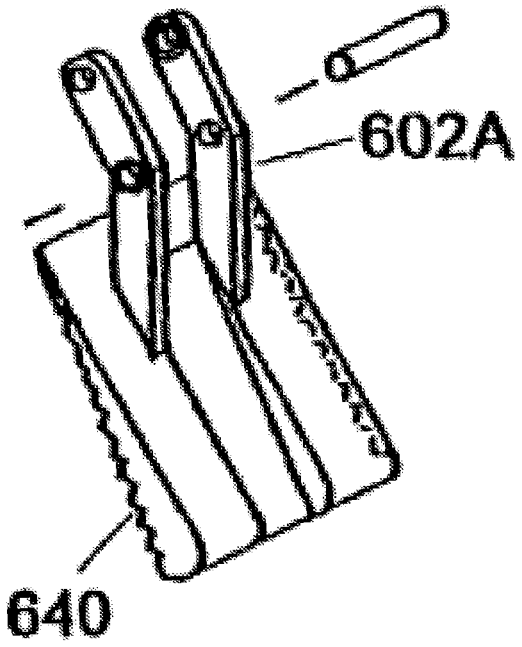
FIG. 9G shows links on the lower guards are angled in the deployed position.
Figure 9H:
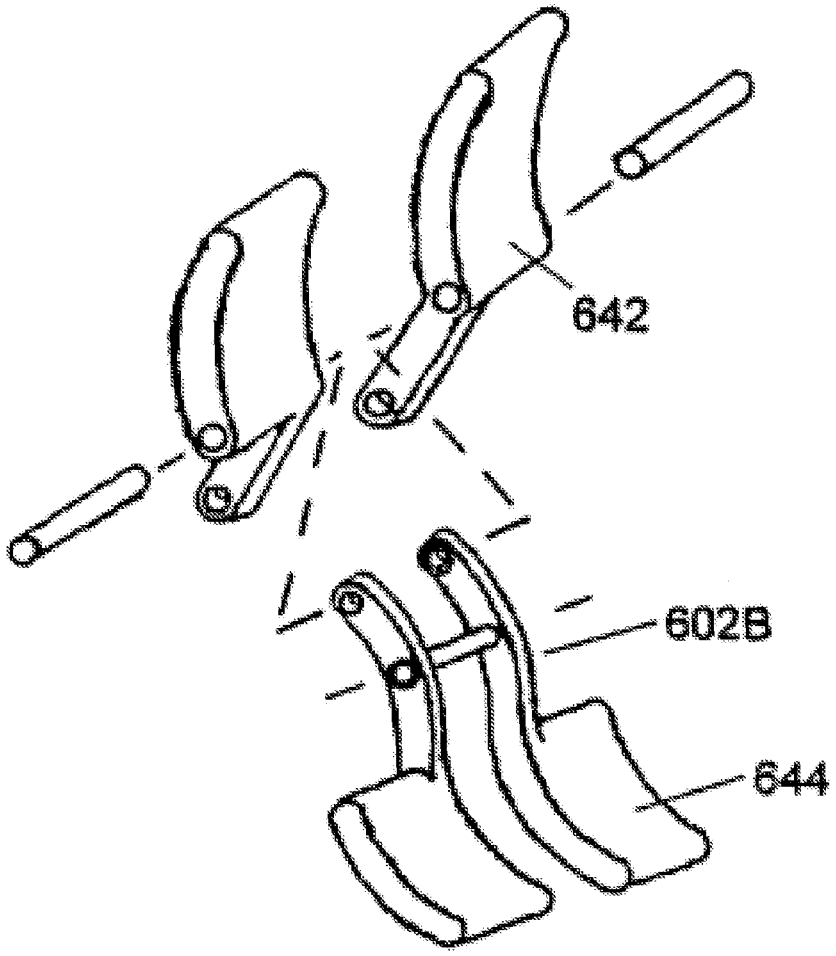
FIG. 9H shows upper and lower guards having paddles with curved surfaces.
Figure 9I:
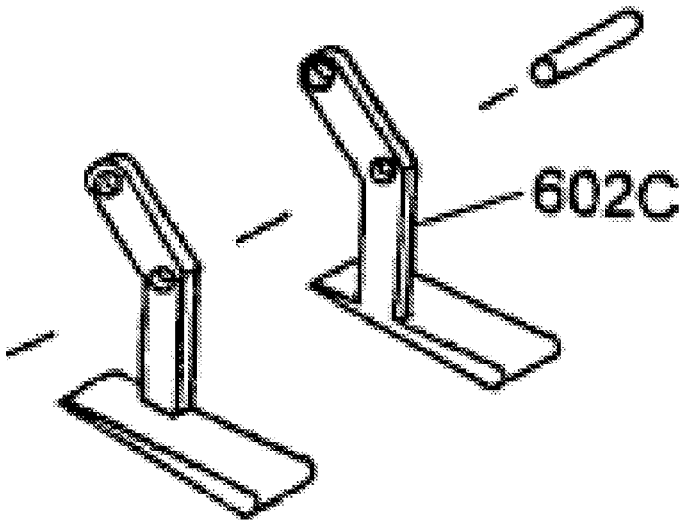
FIG. 9I illustrates another configuration for the links.
Figure 9J:
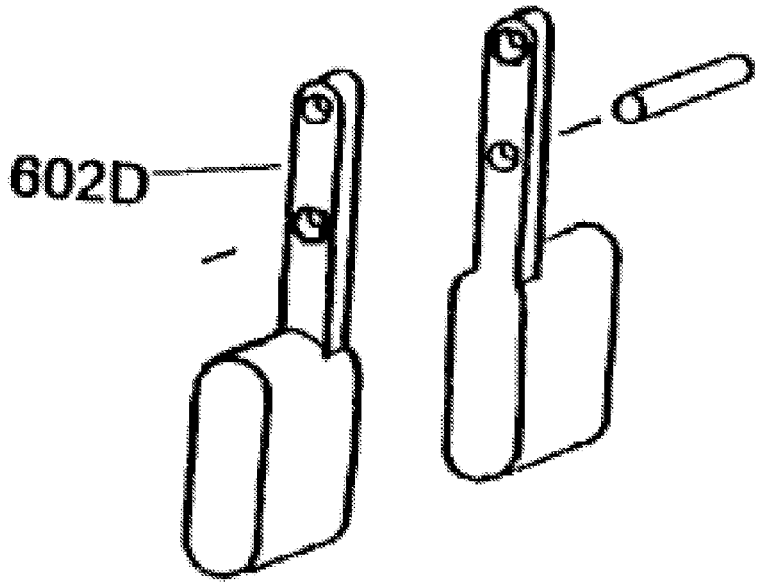
FIG. 9J illustrates yet another configuration for the links.
Figure 9K:
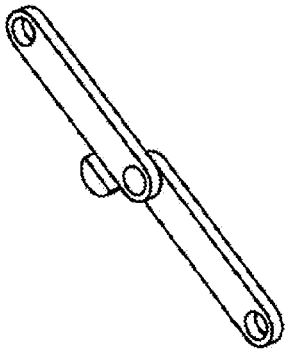
FIG. 9K shows a link having a dual hinge.
Figure 9L:
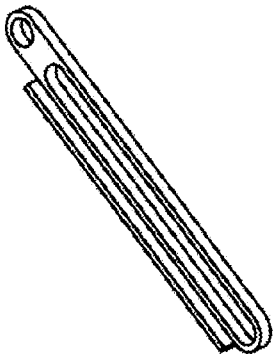
FIG. 9L shows links which are slotted and slides on a stud on the blade.
Figure 9M:
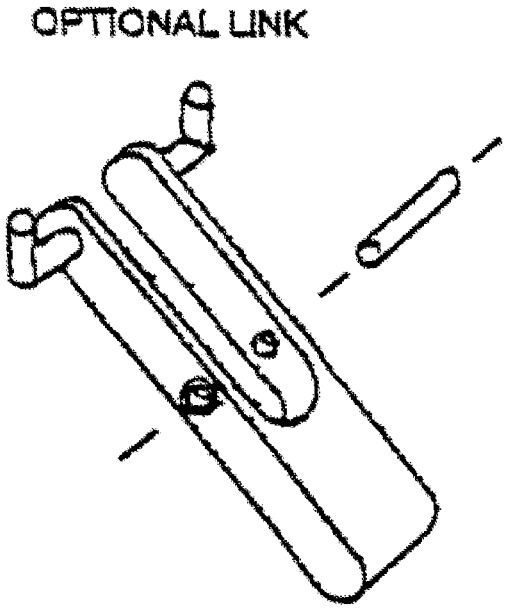
FIG. 9M shows an optional link.
Figure 9N:
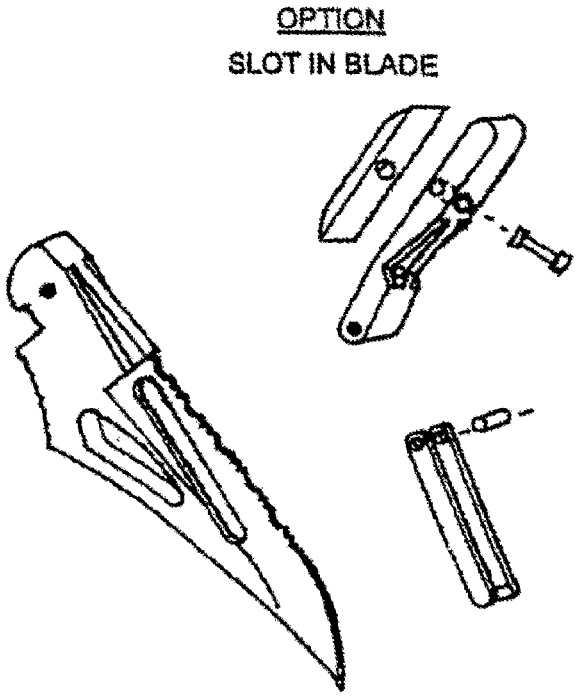
FIG. 9N is a detail view showing an option to FIG. 9D in which the slot is in the blade.

FIGS. 9 to 9L

In these embodiments, links are attached to the guards to raise the guards. The knife is as previously described having a blade 20 pivotal on pivot pin 32 which extends between the handle sections. Liners may also be incorporated as has been described.

In FIGS. 9 and 9A, a link assembly 425 has a pair of links 426, 427 joined by a pin 428. The pin 428 extends through a slot 430 in the blade. The links 426, 427 are each pivotally attached to a guard 50, 50A respectively. The guards sit on top of the handles 12 in the closed position. The links may be attached to various locations on the guards. FIG. 9 shows the links attached to the inside of the guards; however any exposed location such as on the outside or nearer the top end of the guards will work. The links are pivotal on pin or rivet 440.

The blade 20 may be manually rotated to an open position at stud 60. The opening and closing movement of the blade 20 will raise and lower the guards 50, 50A as the linkage assembly slides in slot 430. The shape and length of the slot can vary depending on the physical shape and dimension of the knife, blade and guards. FIG. 9B shows an optional construction in which thumb stud 60 is provided on the opposite ends of pin 428.

FIG. 9C shows a similar arrangement in which slots 455 are provided in the guards 50, 50A and the link pins 454, 456 on links 450, 452 engage the slots 455. Rotation of the blade 20 will pivot the guards via the links. The guards pivot on the blade pivot axis 28 and the links pivot on stub shaft 460. The ends of the shaft 460 are compressed after the links are attached to retain the links 460.

In FIG. 9D, the lower end of linkage assembly 502 is attached to the blade 20 and at the other end is slidable along a slot 506 in guard 50. The linkage will raise or deploy the guard. The forward movement of the guard is stopped by engagement with the rear of the tang section 28 of the blade. For comfort and convenience, the guard 50 may be provided with an elastomeric pad 510 which may be adhesively secured to the rear of the guard.

FIG. 9E shows another variation of the knife of the present invention in which quadruple guards are actuated by links engaging a slot in the blade. The knife blade 20 is pivotal in handles 12 on pivot pin 32. Top guards 50, 50A are angular and also pivot on pin 32. The lower guards are connected to the top guards at pin 38.

The lower guards 50B, 50C have angled links 602. The ends of the links are bored at 620 and pivot on pin 38. The blade 20 defines a slot 630 and pin 634 extends through the slot 630 at intermediate bores 632 in the links. Rotation of the blade 20 to the open position shown in FIG. 9F will simultaneously deploy the upper guards 50, 50A and the lower guards 50B, 50C in a position generally perpendicular to handle 12.

In FIG. 9G, the links 602A on the lower guards are angled to the guards, when deployed, are at approximately 45° with respect to the handle. Ridges 640 are provided to reduce slip when the user's thumb is in contact with the lower guards.

In FIG. 9H, the upper and lower guards 50 to 50C each have paddles 642, 644 with curved surfaces.

FIGS. 9I and 9J illustrate other configurations for the links 602C, 602D to provide guards which, when deployed, are variously oriented and positioned to conform to the preference of the user.

FIGS. 9K and 9L

FIG. 9K shows a dual hinged link that eliminates the need for a slot in the blade. The upper links are pinned to the guard at 440. The lower links are pinned to the fixed stud on the blade. The links fold up next to one another. The thumb stub on the link pinned to the blade is eliminated as it would interfere with the folding operation.

FIG. 9L shows a slotted link that also eliminates the need for a slot in the blade. The upper end of the link is pinned to the guards at 440. The lower end of the link slides on a stud 60 on the blade.

FIG. 10

Figure 10:
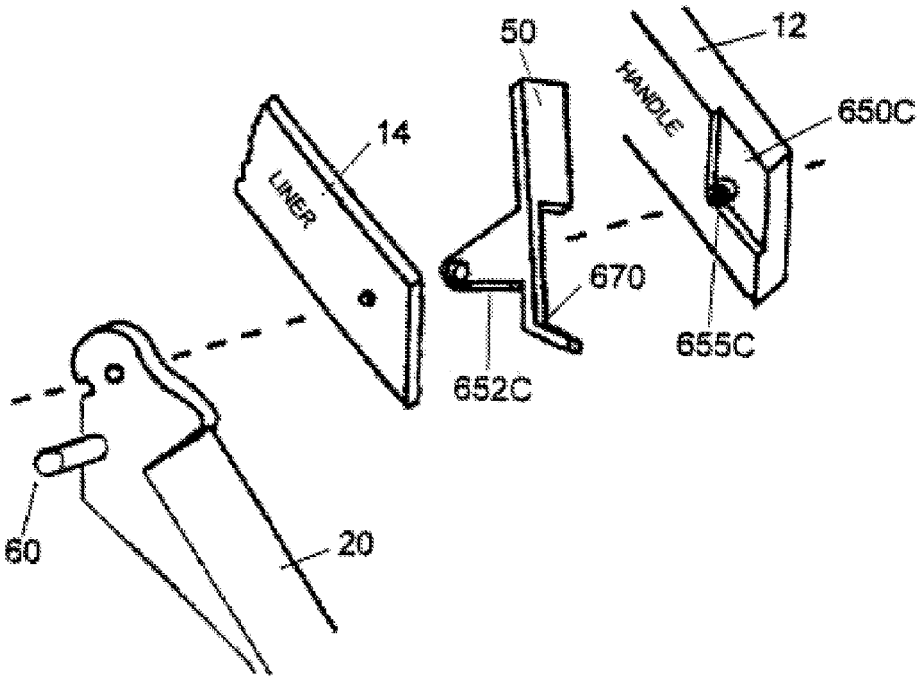
FIG. 10 shows an embodiment having a guard and a thumb stud which may open or close the guard.

In FIG. 10, the guard 50 has a projection 652C which is received within recess 650C on the inner side of handle 12. The guard 50 is pivotal on pivot 655C. A cut-out 670 contacts the thumb stud 60 to lift the guard when the blade is opened. The thumb stud 60 engages the guard 50 at opposite ends to either raise or lower the guard.

FIG. 11

Figure 11:
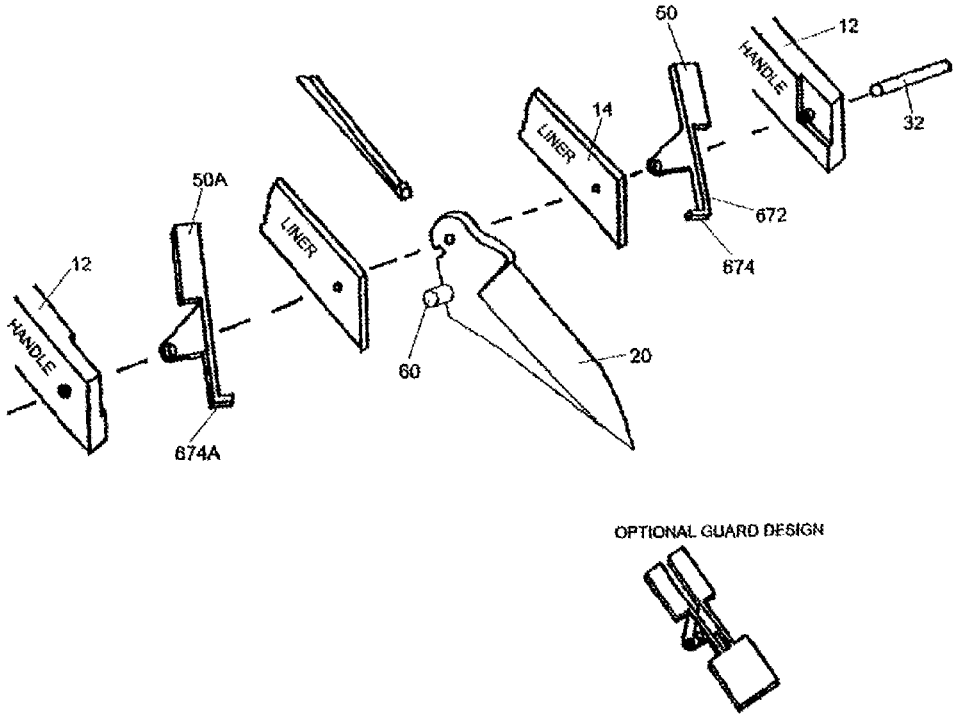
FIG. 11 shows an embodiment of a guard that hooks the back of the deploying blade to open the guard.

In FIG. 11, the guards 50, 50A each have a projection 674 extending from their lower ends 672. The blade 20 and the guards are pivotal about pivot pin 32. The thumb stud 60 closes the guards. The guards are deployed to an open position by the spine or back of blade 20 engaging the projections 674, 674A.

Figure 12:
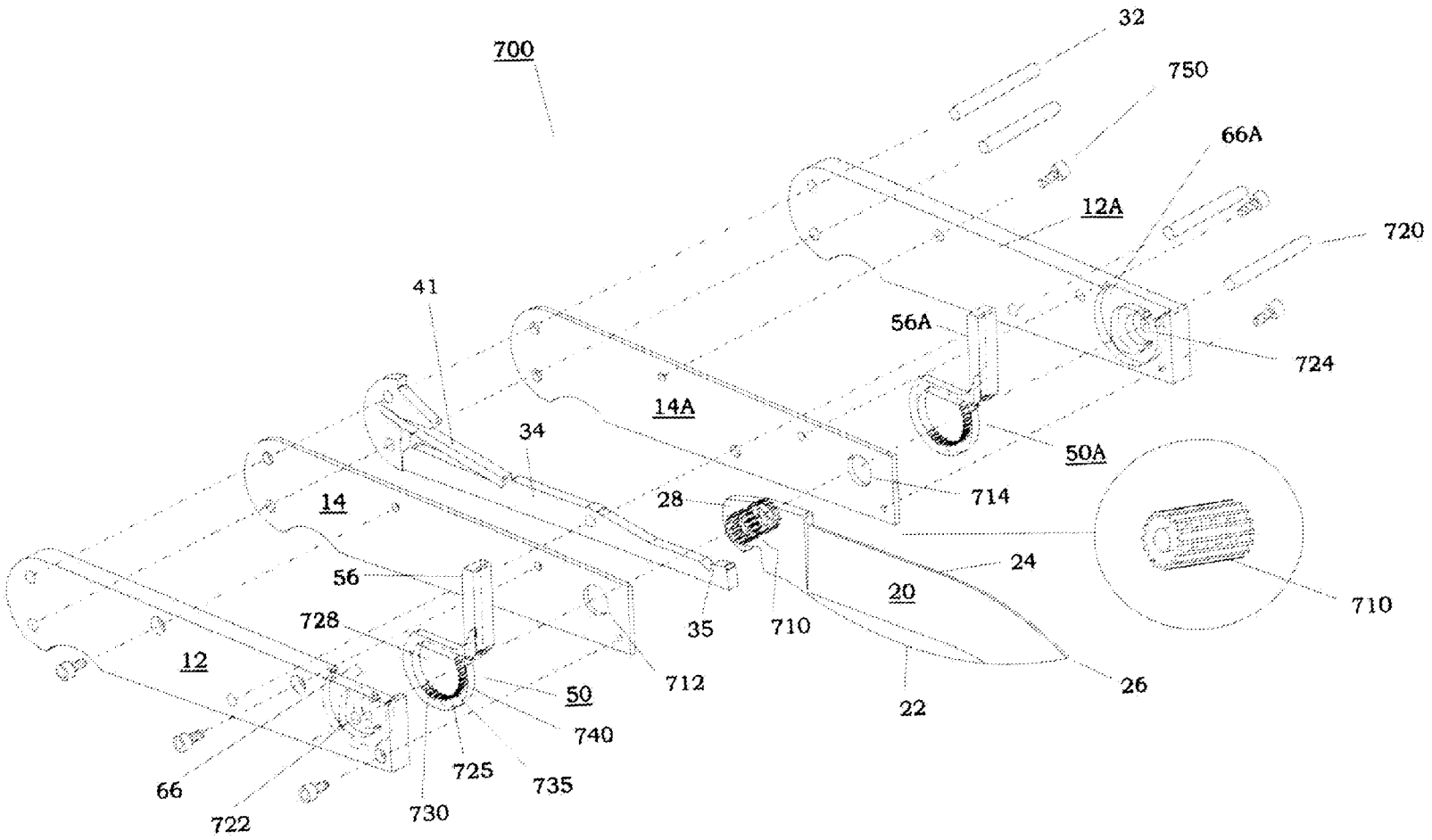
FIG. 12 is an exploded view of an embodiment having a blade guard which is raised and lowered by a gear.
Figure 13:
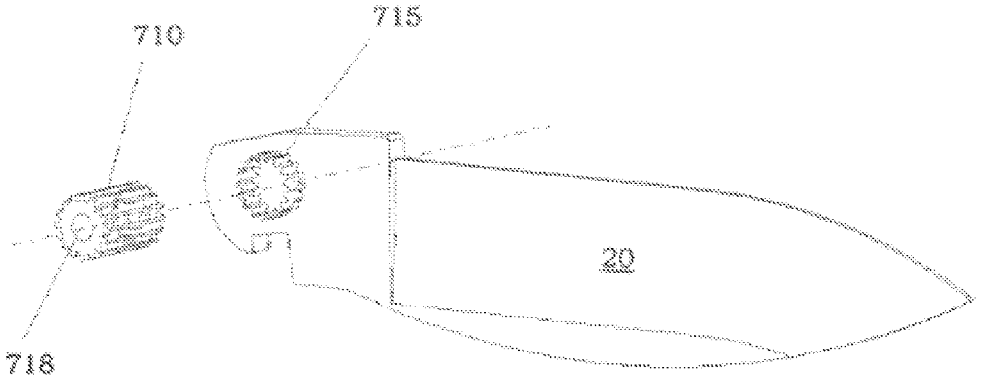
FIG. 13 is a detail view of the blade and gear seen in FIG. 12.

FIGS. 12 and 13

FIGS. 12 and 13 show yet another embodiment of the invention identified by the numeral 700 having opposite handle sections 12, 12A. Liners 14, 14A are positioned along the inner sides of handles 12, 12A.

The main blade 20 is positioned between the liners 14, 14A and, as previously described, the blade has a back 22, blade edge 24, tip 26 and a rear tang 28. A leaf-style rocker bar 34 assists to maintain the blade in an open position having a detent 35 at its forward end. The rocker bar 34 has a spring 41, as has been previously described.

The blade is pivotal about a gear 710 projecting from opposite sides of the blade in the tang area 28 extending through a complementary grooved bore 715 in the tang area. The blade and gear may also be fabricated as an integral assembly as by machining. The gear 710 may be a spur gear having a plurality of straight cut teeth of a predetermined pitch or may be other profiles such as bevel gears or helical gears. The gear 710 extends through circular bores 712 and 714 in the liners and the gear has a central bore 718 which receives pin 720. The pin 720 extends through the liners 14, 14A and is received in bores 722 and 724 on the inner sides of the handles.

A pair of safety guards 50 and 50A are positioned between the liners 14, 14A and the adjacent handle section. The guards each have an annular body 725 having projecting finger guards 56, 56A. The annular body 725 defines a central bore 728 having a diameter approximately twice the diameter of the gear 710. A ring gear section 730 of the body 725 is provided with teeth 735 which match the profile and pitch of the teeth on the gear 710 and are in engagement with the gear 710. Teeth 735 extend approximately 180° around the inner surface of the ring gear section. The rotation axes of the ring gear 730 and gear 710 are displaced from one another and generally operate in the manner of a planetary gear system. The outer, smooth periphery 740 of the body 725 of each of the guards seats in a recess 66, 66A on the interior face of the handle. The recesses 66, 66A are semi-circular so that the guards may rotate on the surfaces of the recesses held in place by the handle and liner. The knife assembly is secured by pins 32 and setscrews 750 as seen in the FIG. 12 drawing.

When the knife is in the fully open position shown in FIG. 12 with the blade 20 extended, the guards 56, 56A will be in a position generally perpendicular to the handle. When the blade is manually rotated to a closed position, the gear 710 is in engagement with the ring gear and will rotate the guards 50, 50A to a closed position resting against the top of the handle or received in a recess on the handle, not shown. The relationship of the gear 710 and the larger ring gear 730, having teeth extending only partially around the inner side of the ring, will result in the guards rotating only about 90° between the closed and open positions. Manual rotation of the blade in one direction, clockwise as viewed in FIG. 12, opens or raises the guards and blade rotation in the opposite direction will cause the blade to return to a stored position and will simultaneously cause the guards to return to a position against the handle. The engagement of the gear teeth on the ring gear 730 and the spur gear will hold and lock the guards 50, 50A in their open or closed position, providing safety.

Figure 14:
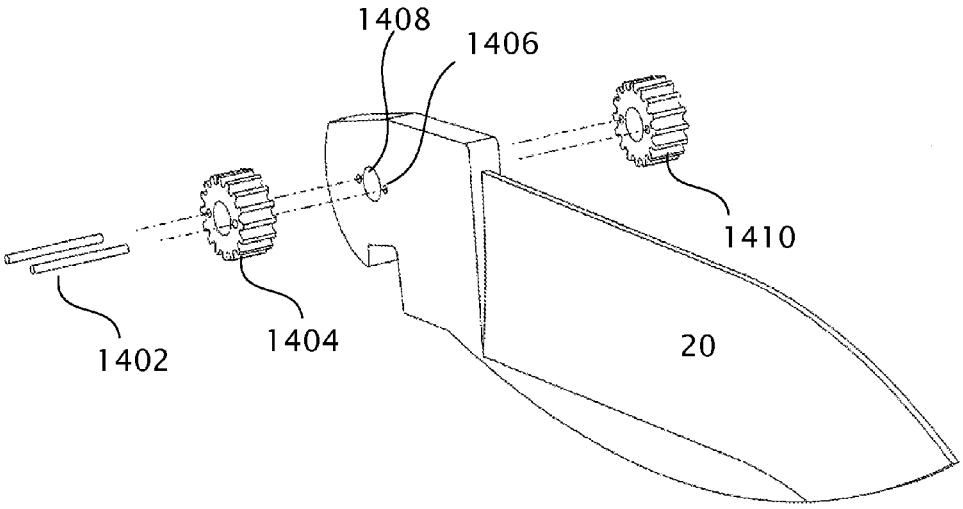
FIG. 14 is an alternative example of the blade and gear seen in FIG. 12 in which two gears are pinned to the blade.

FIG. 14 is an alternative example of the blade and gear seen in FIG. 12 in which two gears are pinned to the blade. As shown here one or more pins 1402 may be utilized to fix a pair of lift gears 1404, 1410 to the blade 20. Fixing the lift gears 1404, 1410 to the blade 20 allows the blade 20 to rotate in unison with the lift gears 1404, 1410 without slipping. Apertures 1406, 1408 are disposed in the blade 20, and match apertures disposed in the gears 1404, 1410, and are generally circular in shape. The pins 1402 are disposed through their matching apertures in the gears 1404, 1410, and the blade 20 to fixedly secure the gears 1404, 1410 to the blade 20. In alternative examples the pins need not be of the same size, or of the same material. Also the pins may be press fit into the apertures to securely retain the gears to the blade. Alternatively any acceptable way of fixing the pins in the aperture may be employed.

Figure 15:
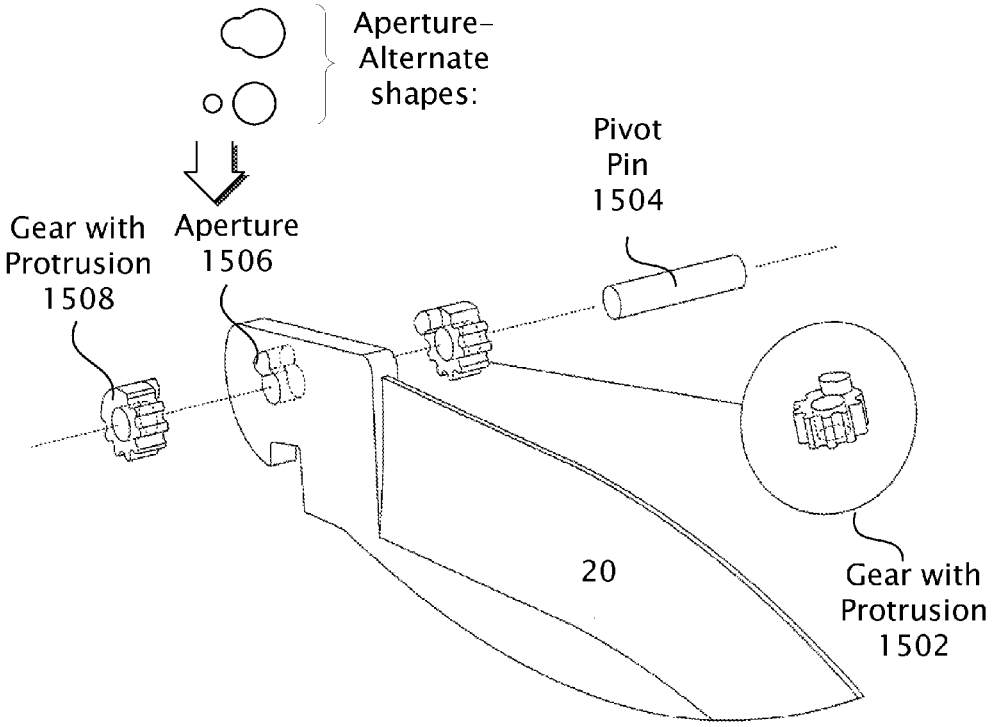
FIG. 15 is a further alternative example of the blade and gear seen in FIG. 12 in which two gears are coupled to the blade utilizing a protrusion formed into the gear to couple the gear to the blade.

FIG. 15 is a further alternative example of the blade and gear seen in FIG. 12. Here, two gears 1502, 1508 are coupled to the blade 20 utilizing a protrusion formed into the gears 1508, 1502 to rotatably couple the blade 20 at a tang end to the gears 1502, 1508.

Gears 1502, 1508 are conventionally constructed from any suitable material. However the gears include a nub or protrusion disposed on a gear face such that the protrusion travels about the axis of rotation of the gear, as the gear is rotated. The gear and protrusion may be formed by cutting, casting or any suitable method. The gears 1502, 1508 also include an aperture disposed through their axis of rotation. As shown the aperture is generally circular to accommodate a pivot pin 1504 that enables the gears 1502, 1508 and the blade 20 to rotate in unison. The aperture is generally circular to accommodate a round pin.

The blade 20 includes an aperture, or a compound aperture 1506 formed in the tang area. A single aperture may be formed to accept the pin 1504, and the protrusions on the gears 1508 1502. For example the first aperture may be circular in shape to accommodate a generally round pivot pin 1504. A second aperture may be disposed in the blade to accommodate the protrusions disposed on the gear faces of the gears 1502, 1508. This second aperture may intersect the first aperture to form a single irregularly shaped aperture. Alternatively, the second aperture may not be adjacent to the first aperture. The aperture 1506 may be formed in a single operation or in several operations by any suitable method.

The assembly is formed by disposing the gears 1502, 1508 on opposite sides of the blade 20, such that protrusions on the gears 1502, 1508 are disposed in the aperture 1506. The pivot pin 1504 is accommodated by the apertures disposed in the gears 1502, 1508 and the portion of the aperture 1506 in the blade 20, not already occupied by the protrusions on the gears 1502, 1508. In this arrangement the protrusions on the gears help to fix the gears to the blade so that the gears rotate with the blade, without slipping.

While the invention has been described with reference to folding knife applications, it will be appreciated that the invention may be applied to other tools which have a folding element such as folding saws.

It will be obvious to those skilled in the art to make various changes, alterations and modifications to the invention described herein. To the extent such changes, alterations and modifications do not depart from the spirit and scope of the appended claims, they are intended to be encompassed therein.

Those skilled in the art will realize that the process sequences described above may be equivalently performed in any order to achieve a desired result. Also, sub-processes may typically be omitted as desired without taking away from the overall functionality of the processes described above.

The invention claimed is:

1. A folding knife having a handle, a blade with a tang, spine and a knife edge, said blade being pivotal approximately 180° between a closed position with the blade received in the handle and a fully opened position with the blade extending forwardly from the handle, said knife comprising:

(a) a folding guard defining a ring gear with an inner and outer side having a plurality of teeth disposed on the inner side of the ring gear; said ring gear having a generally smooth outer surface;

(b) a safety finger extending from said ring gear having a front surface and a rear surface;

(c) said handle defining an arcuate seat rotatably receiving the outer surface of said ring gear;

(d) a lift gear on said tang, said lift gear located within the ring gear and having gear teeth engaging the teeth on the ring gear which will cause the folding guard to rotate to a locked position generally perpendicular to the handle when the blade is fully opened and will cause the guard to rotate to a position against the handle when the blade is pivoted to the closed position;

(e) an axially-extending protrusion formed on the lift gear; and (f) the lift gear and the ring gear are on at least one side of the blade.

2. The folding knife of claim 1 wherein the lift gear has one or more protrusions.

3. The folding knife of claim 1 wherein the protrusion on the lift gear extends into the blade, and said lift gear is positioned on at least one side of the blade and is in contact with the folding guard.

4. The folding knife of claim 1 wherein the blade has an aperture formed to accept and hold the protrusion of the lift gear.

5. The folding knife of claim 4 wherein the aperture in the blade includes two adjacent bores formed through the tang.

6. The folding knife of claim 3 in which an aperture is formed in the blade to accept and hold the protrusion on the lift gear.

* * * * *